United States Patent [19]

Navi

[11] 3,960,291

[45] June 1, 1976

[54] FOLDED ARTICLE DISPENSING MACHINE

[75] Inventor: Menashe Navi, Lebanon, N.J.

[73] Assignee: ANPA Research Institute, Easton, Pa.

[22] Filed: Sept. 23, 1975

[21] Appl. No.: 615,859

[52] U.S. Cl. ..... 221/36; 271/18; 271/42; 221/97; 221/232; 221/240

[51] Int. Cl.[2] ..... B65H 3/00

[58] Field of Search ..... 221/111, 107, 103, 97, 221/116–118, 226, 228, 229, 232, 236, 238, 241–249, 261, 268, 272–274, 270, 240, 36, 37, 40; 271/18, 19, 21, 42, 109, 128

[56] References Cited

UNITED STATES PATENTS

| | | | |
|---|---|---|---|
| 1,151,347 | 8/1915 | Dueber | 221/274 |
| 3,107,770 | 10/1963 | Short | 221/232 |

*Primary Examiner*—Robert B. Reeves
*Assistant Examiner*—H. Grant Skaggs
*Attorney, Agent, or Firm*—David H. Semmes

[57] ABSTRACT

A machine for dispensing a single newspaper, magazine or the like from the top of the stack which includes a novel horizontally movable stripper assembly which allows dispensing of a single folded article in both a horizontal travel from left to right and the return travel from right to left. The folded articles, such as newspapers or magazines, are partially overlapped symmetrically about a vertical plane of symmetry and urged upwards against the horizontally traveling stripper assembly by a resilient platform. This dispenser has particular utility as a vending device where a single article only, such as a newspaper or magazine, will be dispensed upon selective operation of the horizontally movable stripper assembly in either direction of complete travel.

9 Claims, 12 Drawing Figures

FOLDED ARTICLE DISPENSING MACHINE

BACKGROUND OF THE INVENTION

1. Field Invention the invention

Presently known devices for dispensing newspapers or the like are seen on street corners everywhere in metropolitan areas. In the majority of these machines, a coin is inserted to release a door latch which permits the operator to withdraw one, or more, newspapers from within a hopper. Obviously, the dispensing of the newspaper is highly dependent upon the trustworthiness and social conscious of the purchaser. As a further consequence of these well-known devices, the door invariably includes the coin receptacle and is therefore readily accessible when the door is opened, thus, allowing one with larcenous intent to vandalize the coin receptacle and remove the deposited coins.

Up to this time, there has exsisted a need for a dispensing machine which will ensure that a single folded article is dispensed without such a manufacturing cost and consequent complexity as to prevent its large scale distribution for its intended purpose. Previous devices for stripping a topmost article from a stack have invariably required involved spring return mechanisms and cammed stripper devices to selectively dispense an article in one direction only; any interference with the spring loaded action of the dispenser renders the device inoperable at worst and difficult to operate at best.

2. Description of the Prior Art

The following patents example typical prior art dispensing devices which have in the past been employed for dispensing a topmost sheet from a stack;

| | |
|---|---|
| Great Britain | 888,022 |
| West Germany | 1,251,772 |
| West Germany | 1,185,063 |
| IBM Techn. Bull., Vol. 6, No. 1, June '63, p. 14 | |
| HILLIS | 3,517,855 |
| PANKOW | 3,323,790 |
| CRANSKENS | 3,275,192 |
| HARTER | 3,269,590 |
| LAREAU | 3,260,402 |
| HOUVER | 3,195,886 |
| GEISLER | 2,827,288 |
| HAZARD | 1,014,147 |

Unlike all of these prior art devices, the single article machine according to the instant invention will dispense a single article only in either direction of reciprocation of the stripper assembly.

Great Britian No. 888,002 is a reciprocating feeder for delivering sheets of copying paper wherein movement of a cover engages and pushes a top sheet through an opening in the chamber. This reference employs a roller projection 32 to selectively engage and push a sheet of paper rightwardly, as shown in FIG. 1, upon reciprocation of handle 18.

The German references show sheet dispensers wherein a horizontal reciprocation will feed a top sheet of paper in a single direction. The IBM Technical Bulletin illustrates another conventional mechanism for feeding punch cards through a gripper connected to a periodically reciprocated carriage for single direction card feeding.

The patent to Hillis is a spring loaded sheet dispensing device employing a series of gears and levers to reciprocate a pusher pad 96 into frictional engagement with a top sheet of paper. The patent to Pankow is another spring loaded dispenser particularly suited for dispensing two separate copy sheets which are also held in registration. The patent to Cranskens is a substantial duplicate of West German No. 1,185,063 and employs a roller mechanism particularly suited for dispensing of light sensitive sheets. Typically, the sheet dispenser of Cranskens provides single direction dispensing with a spring loaded return of the reciprocating cover 17.

The patent to Harter is a single sheet dispensing apparatus employing a series of interconnected rollers operated by rotation of a crankshaft 49 for frictionally sliding a top sheet from a stack. The dispenser of Lareau includes a roller mechanism which limits feeding to one direction upon movement of drawer 8. Laueau further requires a friction material at FIG. 1. There is no provision in Houver, nor in the other references noted herein, for delivery of the dispensed sheets through the top of the distributor box. The unilateral movement mechanism as taught herein rely upon the provision of a separate opening for exit of the engaged top sheet of a stack, and do not teach the provision of a reciprocal side mechanisms wherein a roller and wedge assembly both separates and guides the dispensing of a folded sheet.

Finally, the patents to Geisler and Hazard illustrate conventional feeding devices having rollers and plungers employed to selectively hold sheets for individual feeding.

None of these above-noted references teach a combination which even categorically approaches the advantages attendant to the machine according to the instant disclosure. In order to more fully appreciate the invention which is described and illustrated hereinafter, reference is now made to the disclosed and illustrated preferred embodiment of this invention.

SUMMARY OF THE INVENTION

The present invention involves an essentially improved stripper mechanism which allows a simple horizontal reciprocation without the requirement of cammed or interconnected spring loaded mechanisms for effectively and efficiently dispensing a single folded article through the top of a frame. Manufacturing simplicity has been achieved in one respect through the elimination of an articulated stripper device in favor of the horizontal stripper assembly which includes a left and a right wedge assembly when viewed from the front as in FIG. 1, where each stripper is simply a pair of freely rotatable wedges mounted respectively on horizontally positioned shafts. The horizontal shafts for the wedges are mutually parallel to a vertical plane of symmetry and include therebetween a third horizontal shaft which includes a roller to facilitate the discharge of the topmost folded article upon reciprocation in either direction.

To ensure the integrity of the partially overlapped folded stack of folded articles, such as newspaper, magazines or the like, the hopper itself is illustrated in the preferred embodiment to include essentially two hoppers which respectively maintain the folded edges of alternate of the stacked folded articles in vertical planes which are also substantially parallel to the vertical plane of symmetry of the machine. Because the alternating folded edges of the composite stack are prevented from unwanted horizontal or lateral movement, the reliability of the dispensing device as a whole is greatly improved.

Moreover, other features, objects and advantages of the invention will become more apparent by reference of the following detail description with reference to the illustration of the drawing of the preferred embodiment.

DESCRIPTION OF THE PREFERRED EMBODIMENT

Figure 1:
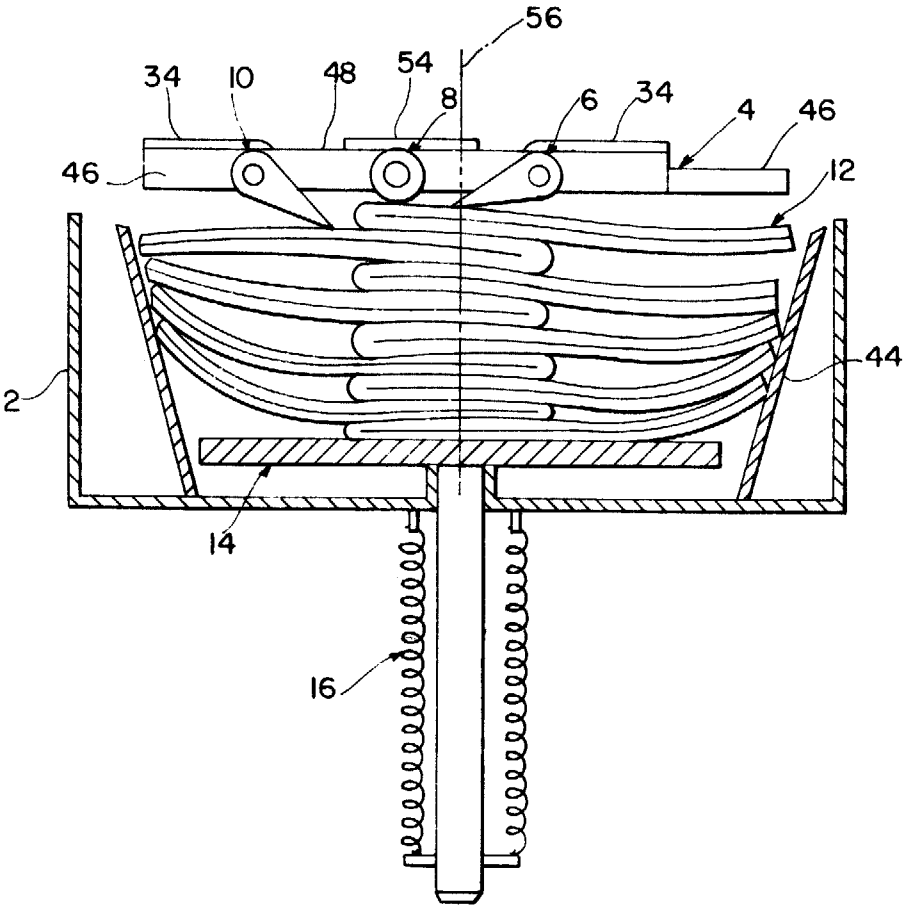
FIG. 1 schematically illustrates in front view the basic operating elements according to the instant invention.

FIG. 1 illustrates the essential functional elements comprising the instant device. Frame 2 contains newspapers, magazines, or the like which are folded about a vertical plane of symmetry denominated as 56. The partially overlapped stacked array of newspapers, for example, are supported upon a spring loaded platform 14 which may be resiliently urged upwardly through provision of an extension spring assembly schematically illustrated at 16.

Figure 2:
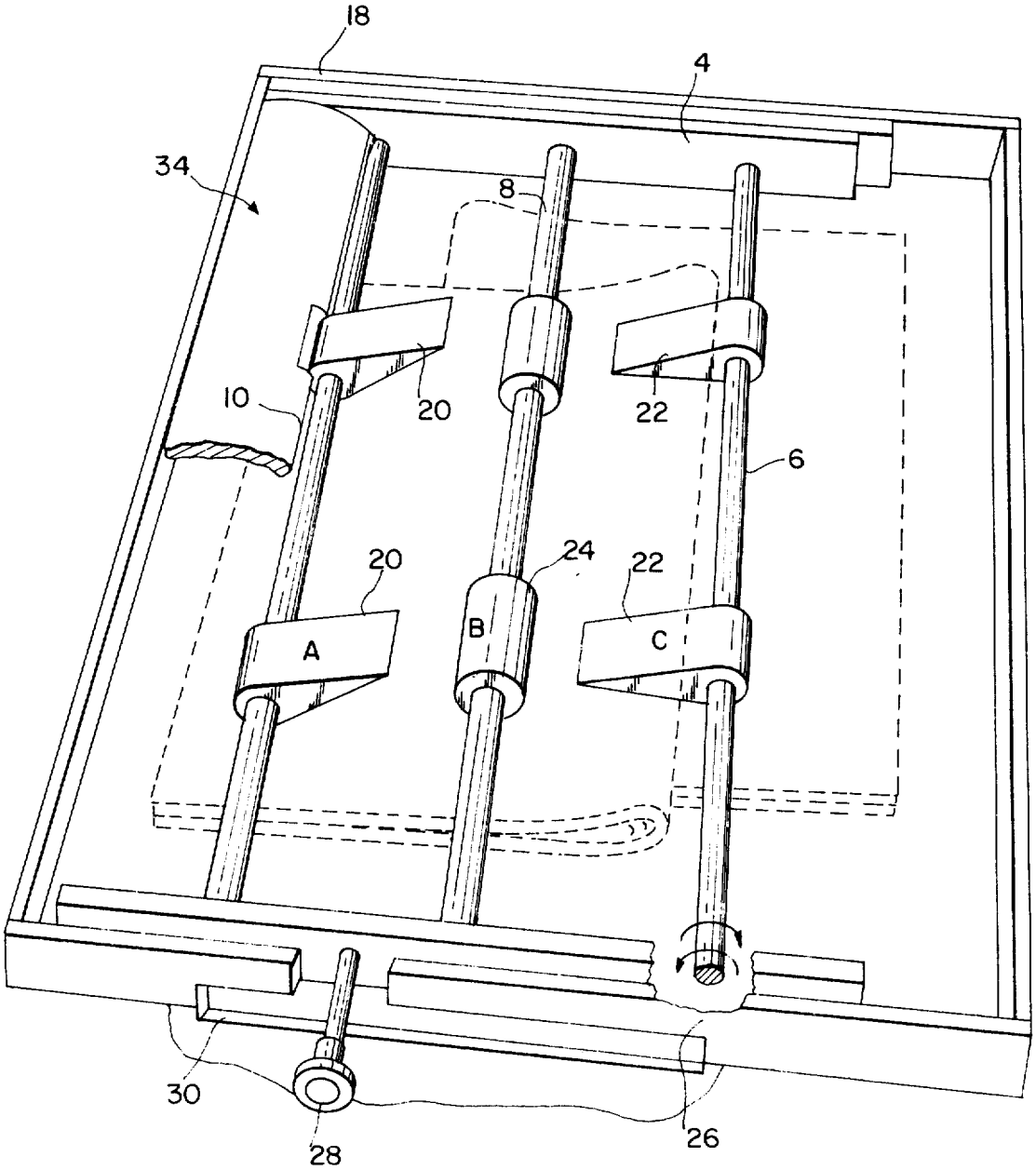
FIG. 2 is a top section view showing a schematic form of the invention.
Figure 3A:
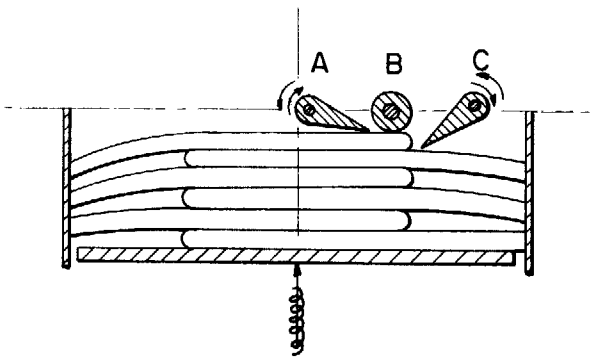
FIGS. 3 (*a–f*) illustrate schematically a sequential operation of the invention.
Figure 3B:
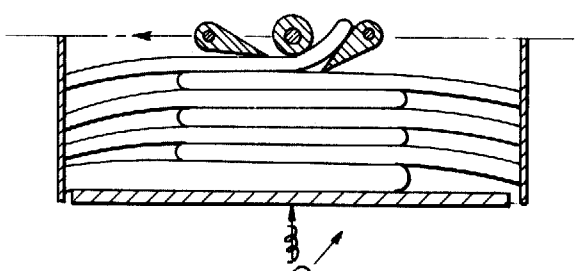
Figure 3C:
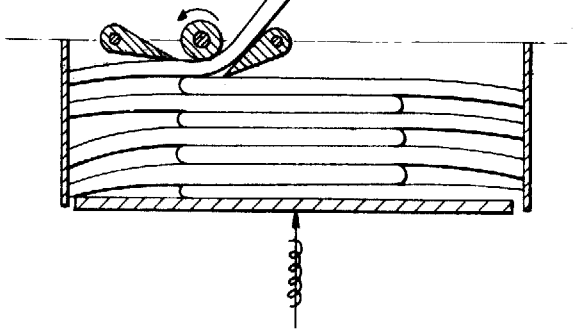
Figure 3D:
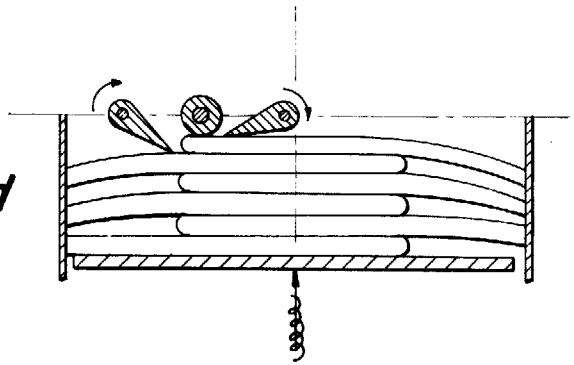
Figure 3E:
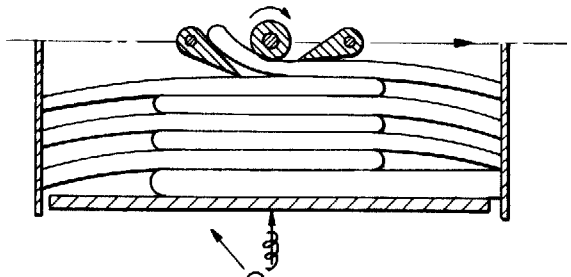
Figure 3F:
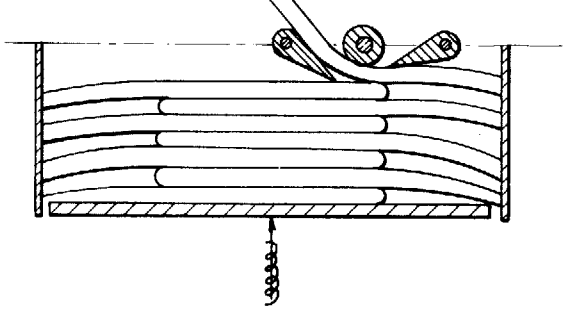

The novel stripper mechanism is horizontally movable on a slide assembly 4 and includes a right wedge assembly 6, a left wedge assembly 10 together with a roller assembly positioned on a third shaft between the wedge assemblies. As shown in FIG. 1 and FIG. 2, the slide mechanism 4 allows a travel from left to right and from right to left and for each of the directions of both travel the stripping action as illustrated schematically in FIGS. 3 (*a–f*) will ensure the vending of a single newspaper or other folded article.

Figure 6:
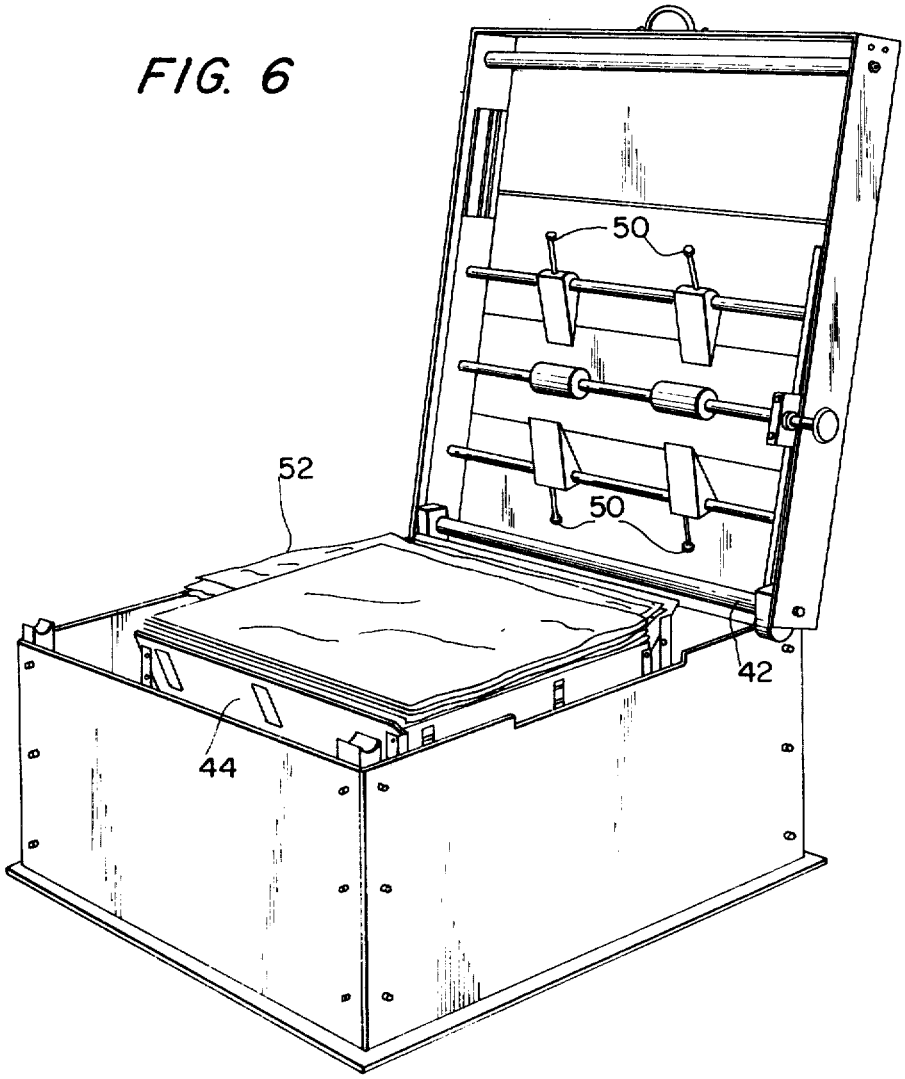
FIG. 6 is an illustration of a loading position.

The slide mechanism may be attached to the frame 2 or, in a preferred embodiment as illustrated in FIG. 6, the entire movable frame assembly is positioned on a pivotable fixed frame top arond hinge 42. The horizontally slideable stripper mechanism itself further includes left and right guide plates 34 to facilitate removal of the topmost article during the stripping operation. The guide cover plates 34 are fixed to the horizontally movable frame and there is further provided a center cover which is also fixed to the movable slide assembly 4. By provision of the center cover 8 in conjunction with the guide plates 34, narrow apertures are defined mutually therebetween so that unauthorized access to the top newspaper, for example, will be rendered difficult if not impossible.

The actuation of the sliding mechanism 4 is conveniently accomplished through provision of a horizontal aperture in the front side of the machine to allow manual reciprocation of the assembly through, for example, a handle 28. The free travel of handle 28 may be conveniently controlled through any type of well-known coin actuated locking mechanism, not illustrated. Any type of latch mechanism to allow a single direction of travel, either from left to right, or right to left, will therefore be possible upon a deposit of the desired amount of coinage. Because the entire assembly comprising frame 2 need not be opened for the vending of an article such as a newspaper, security of the coin holder in the internal integrity of the machine is maintained.

With reference to FIG. 2, the left wedges 20 are fixed to the freely rotatable shaft 10 so that the distal end of the wedge 20 will rest atop the topmost article during travel of the slide mechanism. Similarly, the right shaft is freely pivotable within the slide mechanism 4 and the wedges 22 will rest with their distal end downwardly against the topmost newspaper, for example. Any conventional bearing means 26 may be provided in slide mechanism 4 to ensure smooth operation of these freely pivoting shafts. The shafts 6 and 10 are mutually parallel to each other and the vertical plane of symmetry of the entire device. A roller assembly 8 further includes pressure rollers 24 to cooperate with either wedge assembly for the efficient stripping of only the topmost newspaper or magazine.

Referring now to the sequential operation schematically illustrated in FIGS. 3 (*a–f*) it can be readily seen that in a first rightmost position the distal end of the right wedge will rest against and just to the right of the folded edge of the topmost article. In the sequential reciprocation shown schematically in FIGS. 3 (*a–c*) a horizontal reciprocation will strip the topmost newspaper to allow the user to simply grasp and remove the newspaper from the top of the machine without necessity of entering into the hoper and manually removing one newspaper. As hereinbefore discussed, there is no requirement for complex camming through provision of this stripper assembly since the pivoted wedges will naturally and reliably strip only the topmost article due to the geometrical interrelationship of the shafts and the stacked array of folded articles. The subsequent stripping of the next presented topmost newspaper, for example, is then automatically ensured by the resiliently urged platform which brings the stacked array up against the stripper mechanism for a second direction of stripping as shown in FIGS. 3 (*d–f*). Therefore, it can be readily seen that unlike prior art devices which require return mechanisms and camming devices to ensure alignments of the stripping mechanism, the stripper assembly according to the instant invention operates reliably and efficiently without need of external coordinating devices. This is a particularly and unexpectedly advantageous feature of the instant invention, it allows for low cost of manufacture and utmost in reliability in use. Because there is a bi-directional operation for movement of the stripper assembly in either horizontal direction, there is no chance that the stripper assembly will jam during a return stroke. Of course, there is furthermore no need for any energization for a return stroke resulting in increased reliability and simplification of manufacture.

Figure 4:
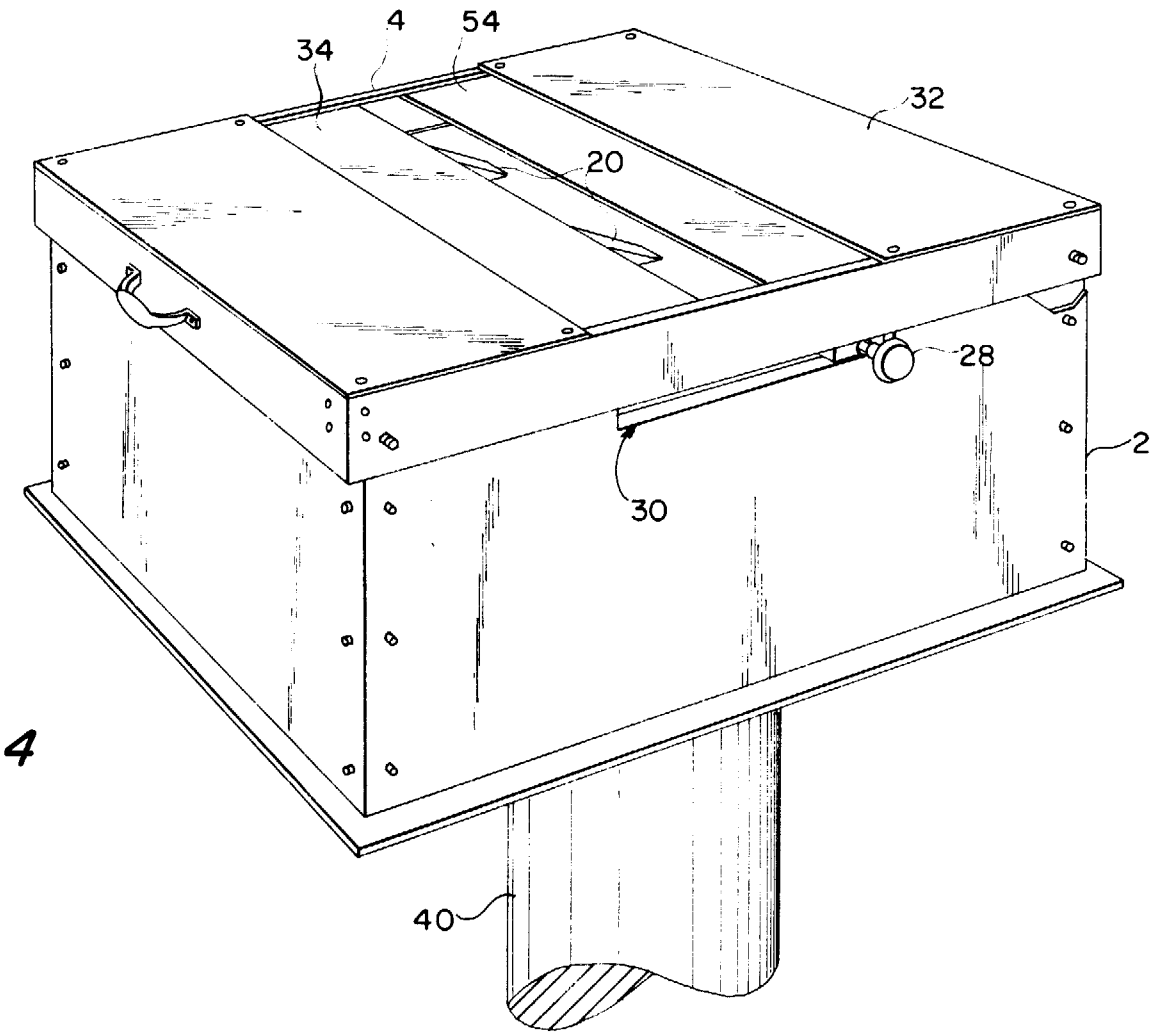
FIG. 4 is a plane view of a schematic embodiment of the invention.

The hinged fixed frame top is a segmented construction with fixed frame top 32 defining a horizontal aperture positioned just over the left guide 34 together with the center movable center cover 54 as shown in the operating position of FIG. 4. Because of this cooperation, unauthorized access to the stacked array of newspapers, for example, is effectively prevented. A consideration of FIG. 4 reveals that when the handle 28 is in the rightmost position the left roller 20 is resting upon the top surface of the topmost newspaper and, with reference back to FIG. 3 (*a*), it can be seen that the external opening is between the left roller and the center roller, respectively A and B in FIG. 3 (*a*) thus rendering it impossible for someone to insert a hand or other article between the elements A and B and remove a paper.

If this machine is employed in remote street corner application, a pedestal support base illustrated at 40 may conveniently be used to house the resilient spring means for the hopper platform.

Figure 5:
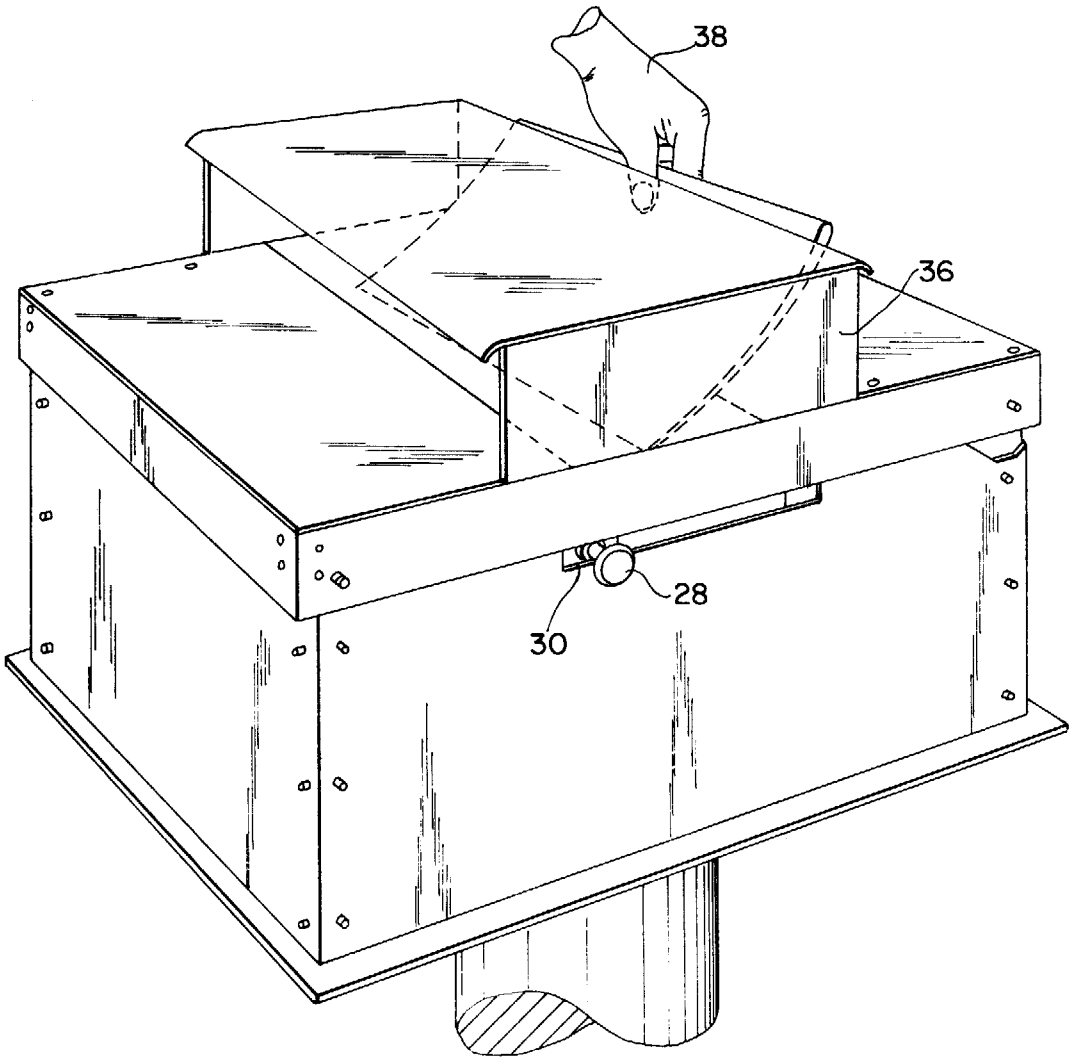
FIG. 5 is an illustration of a modification.

In FIG. 5 a weather cover schematically illustrated at 36 may be of plastic or other material to prevent debris or rain from entering into the inner hopper. As is illustrated, the horizontal cover which, of course, may be of any convenient design, itself does not interfere with a removal of the vented newspaper, as by the hand stylized at 38.

Figure 7:
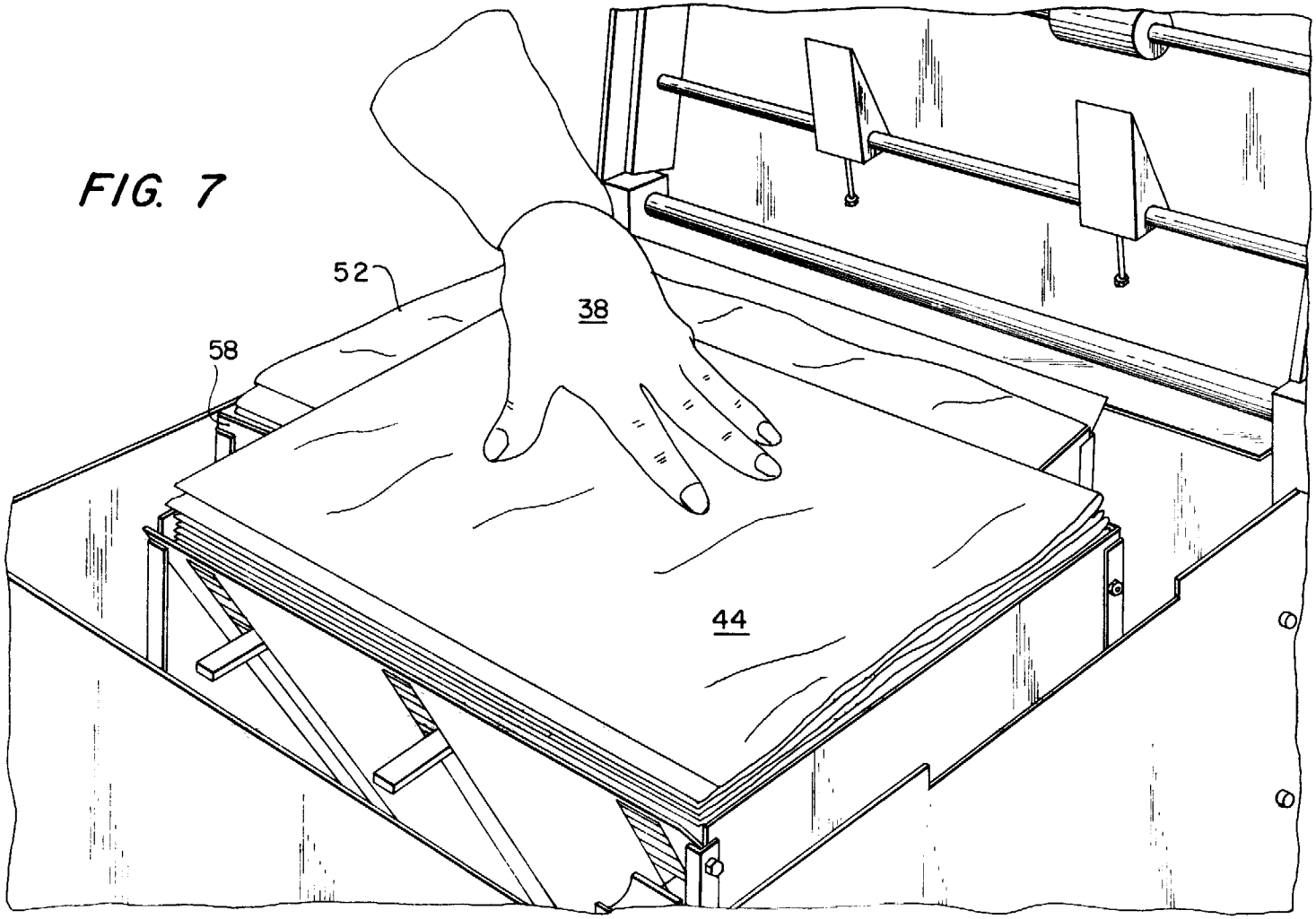
FIG. 7 is a schematic illustration of folded article loading within the machine.

FIGS. 6 and 7 further illustrate that the hopper is itself comprised of two sections laterally offset from front to back. The leftmost hopper 44 is positioned closer to the front face of the frame 2 while the right hopper is positioned laterally backwords closer to the rear surface. As shown most clearly in FIG. 7 when papers are inserted, again by stylized hand 38, the horizontal stop 58 on the right hopper 52 effectively precludes any horizontal movement of the topmost article, or any lower articles within that particular hopper section. Again, with reference back to the schematic operations of FIGS. 3 (*a–f*), it can be seen that a particular vented article does not move horizontally but rather is directed angularly upwards out of and above the horizontal stop as shown at 58 in FIG. 7. The provision of this dual hopper further enhances reliability in that there will be no inadvertent horizontal displacement of the partially overlapping newspapers, for example. As a result of this novel hopper construction, the horizontally positioned folded edges themselves are maintained substantially parallel to the vertical plane of symetry 56.

While one embodiment of the invention has been shown and described, it is to be understood that certain changes and additions can be made by one of ordinary skill in the art without departing from the scope and spirit of the invention which is to be limited solely by the appended claims.

I claim:

1. A sheet dispenser for dispensing a single newspaper, magazine or the like from the top of a stack, comprising in combination:

A. a frame means comprising a hopper means for holding a stack of folded paper articles in a partial overlapping vertical relation wherein the folded edges lie horizontally and overlap the folded edge immediately therebeneath, each folded edge being substantially parallel to a vertical plane of symmetry, and;

B. platform means operable to raise said stack of partially overlapped folded articles, and;

C. a horizontally movable stripper assembly positioned on said frame proximate the top of said stack, said stripper assembly further including wedge and roller means operable to successively strip the topmost folded article in both a horizontal movement from left to right and in a return horizontal movement from right to left.

2. The sheet dispensing machine of claim 1 wherein said hopper means comprises two hoppers for respectively maintaining the folded edges of alternate ends of said stacked folded articles in vertical planes substantially parallel to said vertical plane of symmetry.

3. The sheet dispensing machine of claim 2 wherein said two hoppers are laterally offset, front to back, with means to prevent said alternate folded edges in said composite stack from sliding horizontally.

4. The sheet dispensing machine of claim 1 wherein said platform means includes resilient spring means to urge said stack upwardly against said stripper assembly.

5. The sheet dispensing machine of claim 1 wherein said horizontally movable stripper assembly further comprises a left and a right wedge assembly, each assembly including wedges freely pivotable on horizontal shafts which are mutually parallel to said vertical plane of symmetry, said horizontally movable stripper assembly further including a roller assembly on a third shaft parallel and between said first two horizontal shafts.

6. The sheet dispensing machine of claim 5 wherein movable guide plates are fixed to said movable stripper assembly above each of said first two horizontal shafts, each of said plates extending horizontally from said respective shafts away from said vertical axis of symmetry with a further horizontally positioned movable center cover fixed to said movable stripper assembly above said roller assembly.

7. The sheet dispensing machine of claim 1 wherein said folded articles comprise newspapers.

8. The sheet dispensing mcahine of claim 1 wherein said folded articles comprise magazines.

9. The sheet dispensing machine of claim 1 wherein said frame includes a superposed protective cover positioned above a segmented fixed top, said segmented top including an opening symmetrical about said axis of symmetry.

* * * * *